US006050904A

United States Patent [19]

Kuo

[11] Patent Number: 6,050,904

[45] Date of Patent: Apr. 18, 2000

[54] GOLF CLUB HEAD

[76] Inventor: Allen H. W. Kuo, #6, Alley 2, Lane 15, Taichung-Kang Road Sec. 2, Taichung, Taiwan

[21] Appl. No.: 09/181,054

[22] Filed: Oct. 27, 1998

[51] Int. Cl.[7] ..... A63B 53/04

[52] U.S. Cl. ..... 473/342; 473/345; 473/350

[58] Field of Search ..... 473/324, 329, 473/332, 342, 345, 346, 349, 350

[56] References Cited

U.S. PATENT DOCUMENTS 5,106,094 4/1992 Desbiolles .
5,303,922 4/1994 Lo .
5,433,440 7/1995 Lin .
5,620,381 4/1997 Spalding .
5,713,800 2/1998 Su .

*Primary Examiner*—Sebastiano Passaniti
*Attorney, Agent, or Firm*—Pro-Techtor International Services

[57] ABSTRACT

A golf club head includes a casing having a front opening, and a face panel integral with the casing and covered on the front opening of the casing, the casing having a coupling portion and a coupling groove at the coupling portion around its front opening, the face panel having a peripheral coupling flange raised from a back side wall thereof and terminating in a retaining portion fixedly retained with the retaining portion inside the coupling groove at the coupling portion of the casing.

4 Claims, 9 Drawing Sheets

GOLF CLUB HEAD

BACKGROUND OF THE INVENTION

The present invention relates to a golf club head for a golf club, and more specifically to the fixation between the casing and the face panel for a golf club head.

A regular golf club head, as shown in FIGS. 1 and 3, is generally comprised of a casing B having a front opening and a coupling groove B1 around the front opening, and a face panel A covered on the front opening and fixedly retained to the coupling groove B1. The face panel A has an outwardly extended peripheral coupling portion A1 (see FIG. 1) or beveled peripheral coupling portion A1' (see FIG. 3) retained to the coupling groove B1 at the casing B. When the face panel A is vibrated upon a striking against the ball C, the peripheral coupling portion A1 or A1' may be displaced in the coupling groove B1, causing a gap B2 exists in the coupling groove B1 between the casing B and the peripheral coupling portion A1 or A1' (see FIGS. 2 and 4). When a gap B2 exists in the coupling groove B1 between the casing B and the peripheral coupling portion A1 or A1', the face panel A tends to be forced away from the casing B.

SUMMARY OF THE INVENTION

The present invention has been accomplished to provide a golf club head, which eliminates the aforesaid problem. According to the present invention, the face panel has a peripheral coupling flange raised from a back side wall thereof and terminating in a retaining portion fixedly retained with the retaining portion inside the coupling groove at the coupling portion of the casing. The retaining portion extends from the bottom side of the peripheral coupling flange at right angles or in two reversed directions. The casing has a coupling portion and a coupling groove at the coupling portion for engagement with the peripheral coupling flange and its retaining portion.

DETAILED DESCRIPTION OF THE PREFERRED EMBODIMENT

Figure 2:
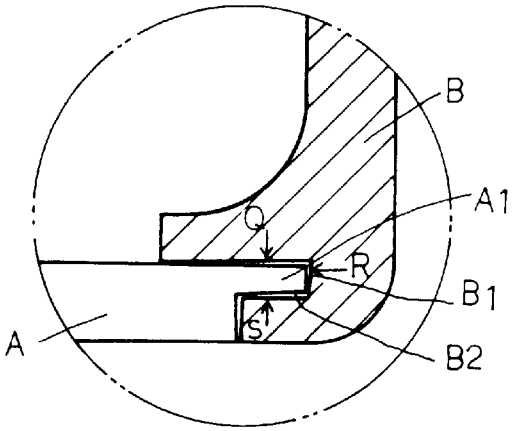
FIG. 2(PRIOR ART)
FIG. 2 is an enlarged view of a part of FIG. 1, showing a gap produced between the casing and the peripheral-coupling portion of the face panel.
Figure 1:
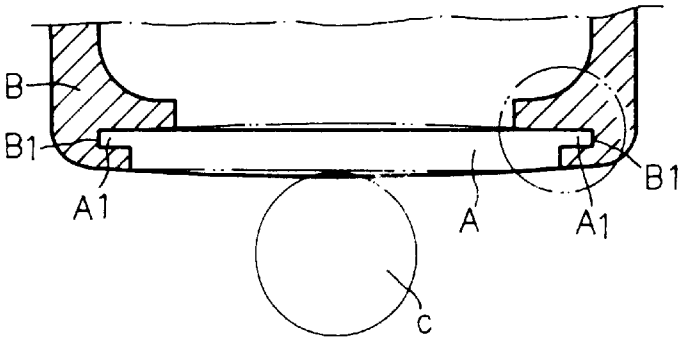
FIG. 1(PRIOR ART)
FIG. 1 is a sectional view of a golf club head according to the prior art.
Figure 3:
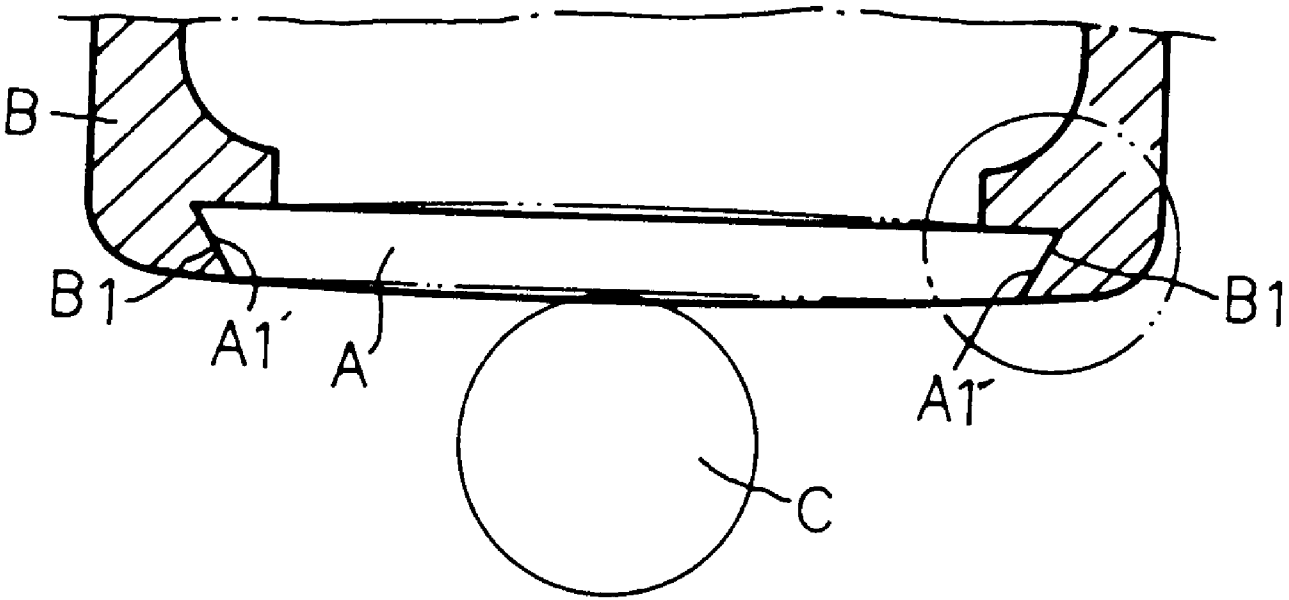
FIG. 3(PRIOR ART)
FIG. 3 is a sectional view of another structure of golf club head according to the prior art.
Figure 4:
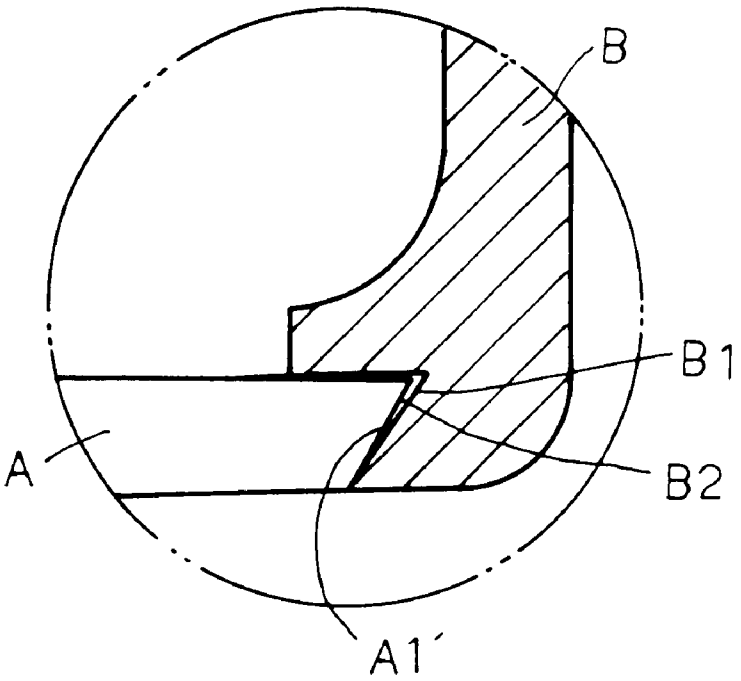
FIG. 4 (PRIOR ART)
FIG. 4 is an enlarged view of a part of FIG. 3 showing a gap produced between the casing and the peripheral-coupling portion of the face panel.
Figure 5:
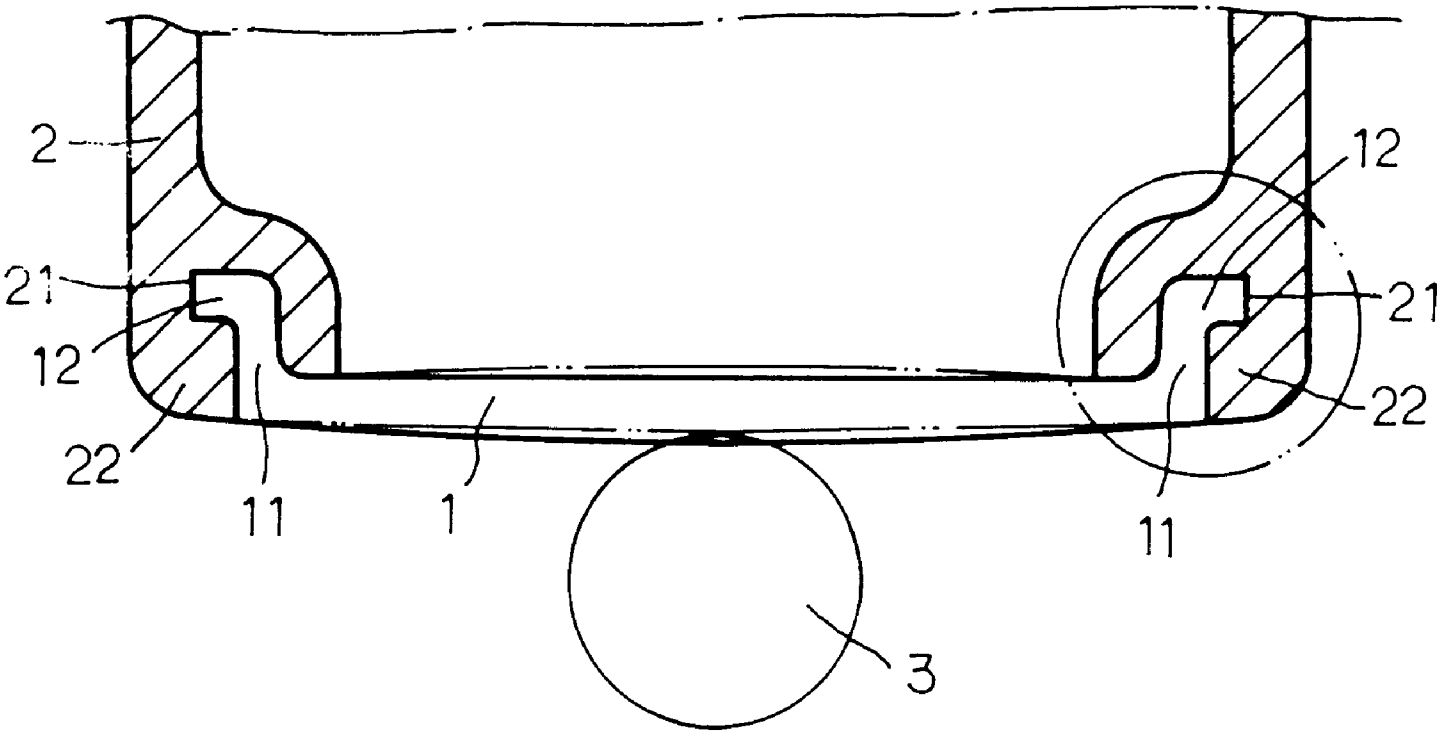
FIG. 5 is a sectional view of a golf club head according to a first embodiment of the present invention.
Figure 6:
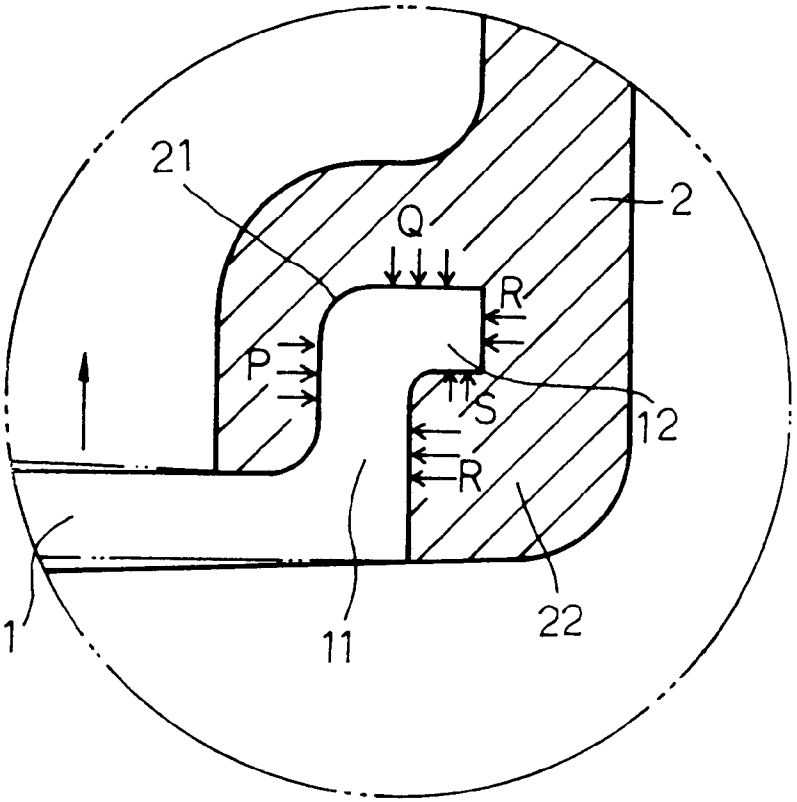
FIG. 6 is an enlarged view of a part of FIG. 5, showing resisting force produced at the coupling portion in contra directions, the peripheral coupling flange retained in position.
Figure 7:
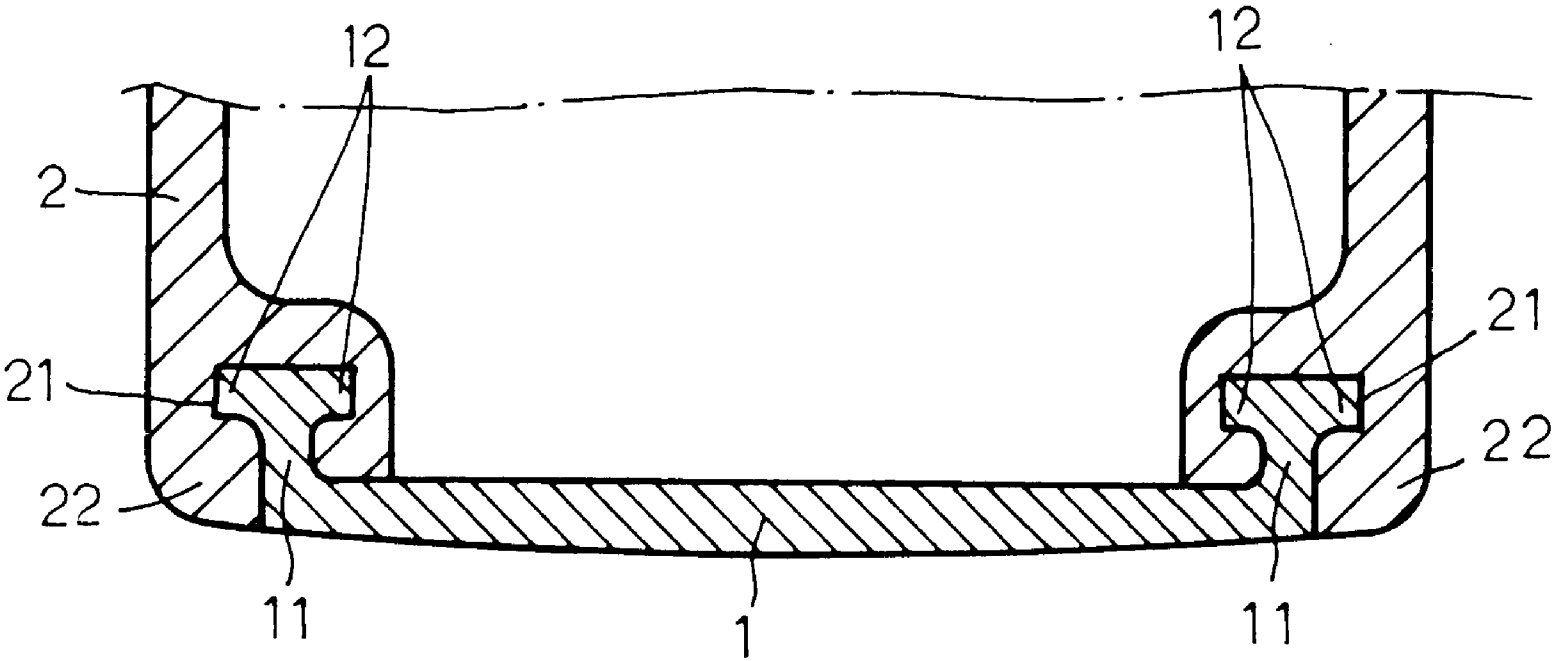
FIG. 7 is a sectional view of a golf club head according to a second embodiment of the present invention.

Referring to FIGS. 5, 6 and 7, a golf club head is shown comprised of a hollow casing 2 and a face panel 1 fixedly fastened to the casing 2. The face panel 1 comprises a peripheral coupling flange 11 raised from a backside wall thereof around the periphery. The peripheral coupling flange 11 has a topside integral with the face panel 1, and a bottom side terminating in a retaining portion 12. In the embodiment shown in FIGS. 5 and 6, the retaining portion 12 extends from the bottom side of the peripheral coupling flange 11 at right angles. In the embodiment shown in FIG. 7, the retaining portion 12 and the peripheral coupling flange 11 form a T-shaped profile. The casing 2 comprises a coupling portion 22 around the front opening thereof, and a coupling groove 21 at the coupling portion 22 for receiving the peripheral coupling flange 11 and the retaining portion 12.

Figure 9:
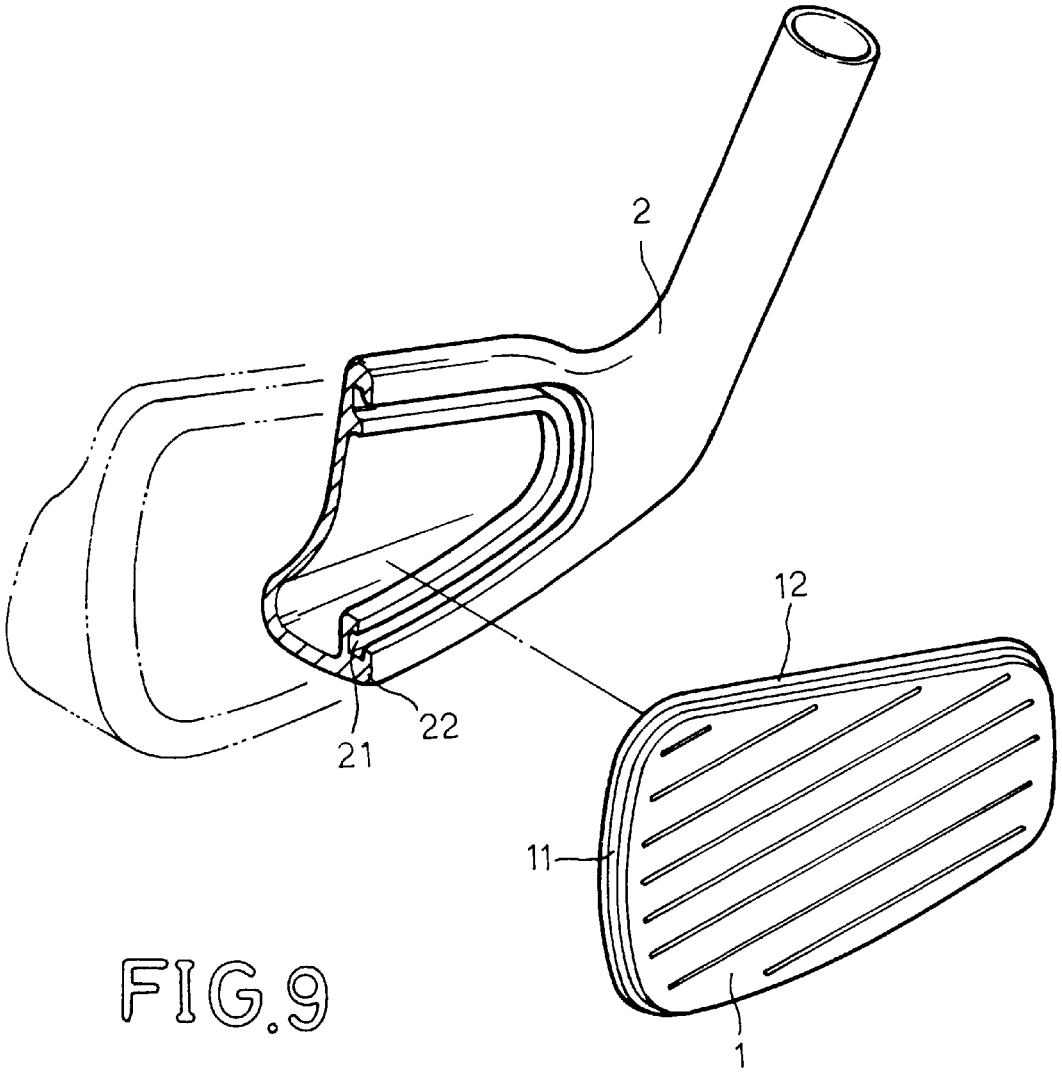
FIG. 9 is a perspective exploded view of a metal golf club head constructed according to the present invention.
Figure 10:
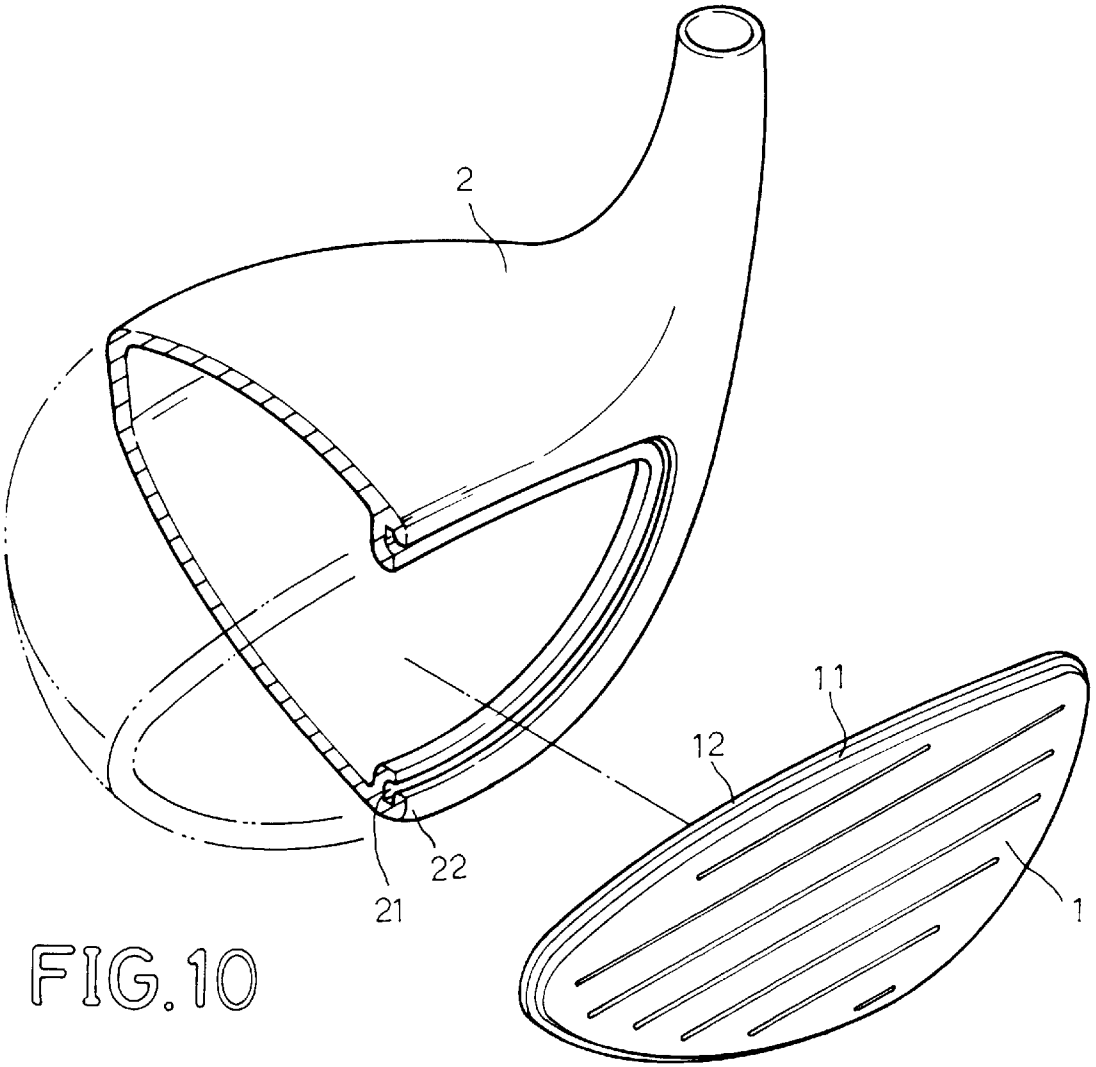
FIG. 10 is a perspective exploded view of a wooden golf club head constructed according to the present invention.

Referring to FIGS. 9 and 10 and Figures from 5 through 7 again, when the face panel 1, is covered on the front opening of the casing 2, and the peripheral coupling flange 11 is tightly engaged with the coupling groove 21 at the coupling portion 22 of the casing 2. Because the retaining portion 12 perpendicularly extends from the bottom side of the peripheral coupling flange 11, in one direction (see FIGS. 5 and 6) or reversed directions (see FIG. 7), the peripheral coupling flange 11 is firmly secured to the coupling portion 22 of the casing 2 and prohibited from displacement when the golf club head is made.

Referring to FIGS. 5 and 6 again, when hitting the ball 3, the face panel 1 is vibrated to lessen shocks, and at the same time resisting force is produced at the coupling portion 22 is different directions P,Q,R,S against the peripheral coupling flange 11 and the retaining portion 12. Because the resisting force in direction R acts against the resisting force in direction P, and the resisting force in direction Q acts against the resisting force in direction S, the peripheral coupling flange 11 and the retaining portion 12 are firmly secured to the coupling portion 22 of the casing 2, and no friction force is produced between the face panel 1 and the casing 2 upon each striking of the golf club head against the ball 3.

Figure 8:
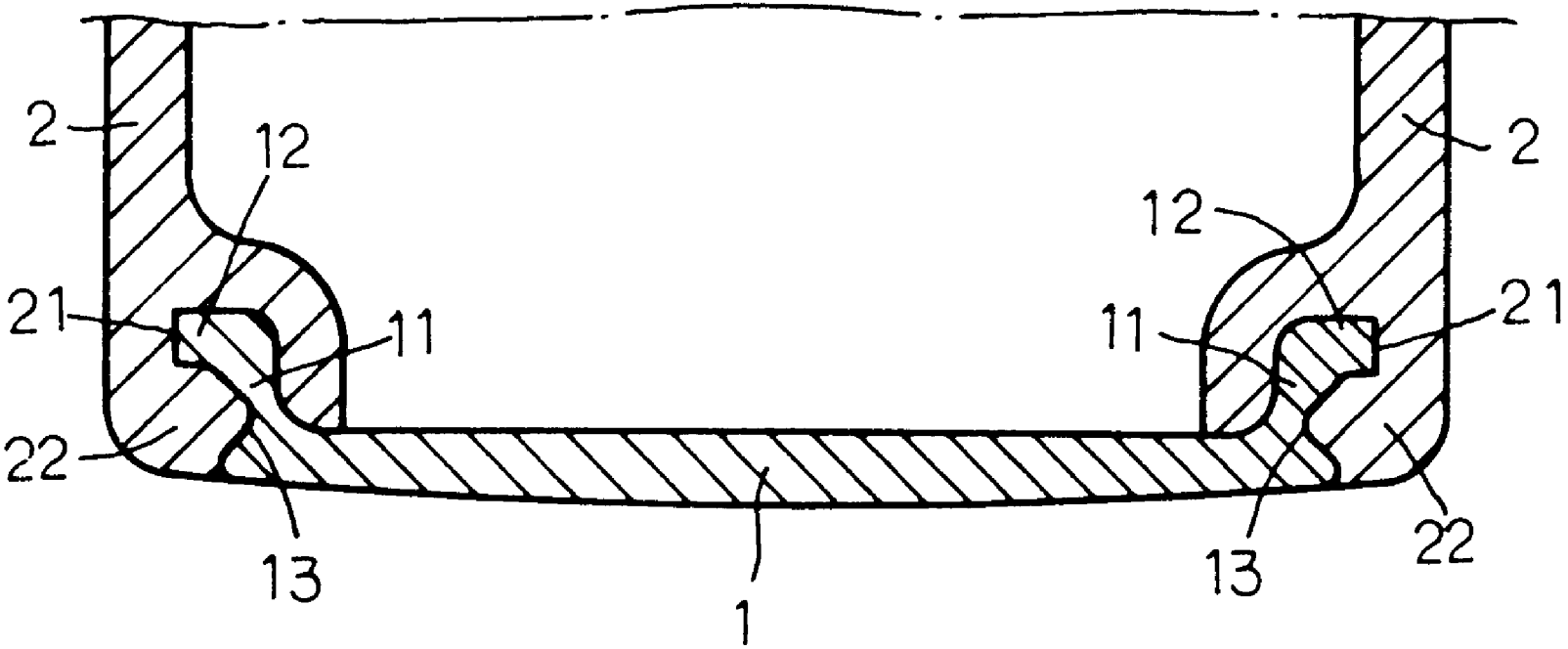
FIG. 8 is a sectional view of a golf club head according to a third embodiment of the present invention.

Referring to FIG. 8, a recessed portion 13 is provided at the peripheral coupling flange 11 at an outer side between the face panel 1 and the retaining portion 12 to increase the contact area between the peripheral coupling flange 11 of the face panel 1 and the inside wall of the coupling portion 22 of the casing 2.

The face panel 1 is cast from high melting point metal such as titanium or stainless steel. The casing 2 can be directly molded on the face panel 1 from metal material having a relatively lower melting point. For example, the casing 2 can be molded from aluminum alloy, copper alloy or zinc alloy.

It is to be understood that the drawings are designed for purposes of illustration only, and are not intended as a definition of the limits and scope of the invention disclosed.

What the invention claimed is:

1. A golf club head comprising a casing having a front opening, and a face panel integral with said casing and covered on the front opening of said casing, wherein said casing comprises a coupling portion around said front opening and a coupling groove at said coupling portion around said opening, said face panel has a peripheral coupling flange raised from a backside wall thereof and fixedly retained in the coupling groove at the coupling portion of said casing, said peripheral coupling flange having a retaining portion extended from a bottom side thereof remote from said face panel at an angle and fixedly retained inside the coupling groove at the coupling portion of said casing.

2. The golf club head of claim 1 wherein said retaining portion extends from the bottom side of said peripheral coupling flange at right angles.

3. The golf club head of claim 1 wherein said retaining portion and said peripheral coupling flange form a T-shaped profile.

4. The golf club head of claim 1 wherein said peripheral flange has a recessed portion at an outer side spaced between said retaining portion and said face panel and engaged with a part of the coupling portion of said casing inside the coupling groove at the coupling portion of said casing.

* * * * *